US009290318B2

(12) United States Patent
Kawata

(10) Patent No.: US 9,290,318 B2
(45) Date of Patent: Mar. 22, 2016

(54) HOPPER AND MEDICINE SUPPLY APPARATUS INCLUDING THE SAME

(75) Inventor: Kenji Kawata, Hirakata (JP)

(73) Assignee: Takazono Technology Incorporated, Hirakata-shi (JP)

( * ) Notice: Subject to any disclaimer, the term of this patent is extended or adjusted under 35 U.S.C. 154(b) by 0 days.

(21) Appl. No.: 13/820,349

(22) PCT Filed: Sep. 1, 2011

(86) PCT No.: PCT/JP2011/069907
§ 371 (c)(1),
(2), (4) Date: Mar. 1, 2013

(87) PCT Pub. No.: WO2012/029908
PCT Pub. Date: Mar. 8, 2012

(65) Prior Publication Data

US 2013/0161356 A1 Jun. 27, 2013

(30) Foreign Application Priority Data

Sep. 3, 2010 (JP) ..... 2010-197383

(51) Int. Cl.
*B65D 88/66* (2006.01)
*B65D 83/00* (2006.01)
*B65D 39/00* (2006.01)

(52) U.S. Cl.
CPC ..... *B65D 88/66* (2013.01); *B65D 39/007* (2013.01); *B65D 83/0094* (2013.01)

(58) Field of Classification Search
CPC .... B65D 83/0409; B65D 88/66; B65D 47/06; B65D 83/0094
USPC ..... 222/196, 202, 203; 220/9.1
See application file for complete search history.

(56) References Cited

U.S. PATENT DOCUMENTS

| | | | | |
|---|---|---|---|---|
| 1,809,091 | A | 6/1931 | Wiken | |
| 3,308,898 | A | 3/1967 | Allen | |
| 3,746,057 | A | 7/1973 | Titchenal | |
| 3,841,535 | A * | 10/1974 | Taupin | 222/502 |
| 4,383,765 | A * | 5/1983 | Gurries | 366/76.3 |
| 4,545,509 | A * | 10/1985 | Musschoot et al. | 222/198 |
| 5,127,483 | A * | 7/1992 | Hough | 177/70 |

(Continued)

FOREIGN PATENT DOCUMENTS

| | | | |
|---|---|---|---|
| CN | 2595663 | Y | 12/2003 |
| CN | 1532117 | A | 9/2004 |

(Continued)

OTHER PUBLICATIONS

Office Action issued by Japanese Patent Office re Japanese Patent Application No. 2010-197382.

(Continued)

*Primary Examiner* — Kevin P Shaver
*Assistant Examiner* — Michael J Melaragno
(74) *Attorney, Agent, or Firm* — The Webb Law Firm

(57) ABSTRACT

A hopper having a passage through which a medicine can be passed downward is provided. The hopper is configured to cause rippling vibration on an inner surface thereof by an external force applied to the hopper. According to this configuration, the rippling vibration applies a force to the medicine to separate the medicine away from the inner surface of the hopper. This prevents the medicine from easily adhering to the hopper.

2 Claims, 6 Drawing Sheets

(56) References Cited

U.S. PATENT DOCUMENTS

| | | | | | |
|---|---|---|---|---|---|
| 5,437,393 | A | | 8/1995 | Blicher et al. | |
| 5,481,855 | A | | 1/1996 | Yuyama | |
| 5,651,479 | A | * | 7/1997 | Bates | 222/196 |
| 5,697,523 | A | * | 12/1997 | Brandauer | 222/58 |
| 5,735,439 | A | * | 4/1998 | Heinrici et al. | 222/199 |
| 5,769,281 | A | * | 6/1998 | Bates | 222/196 |
| 5,960,990 | A | | 10/1999 | Radosevich | |
| 6,011,223 | A | * | 1/2000 | Poller et al. | 177/105 |
| 6,253,968 | B1 | | 7/2001 | Van Dijk et al. | |
| 6,283,178 | B1 | | 9/2001 | Way | |
| 6,786,367 | B2 | | 9/2004 | Schlosser | |
| 7,118,010 | B2 | * | 10/2006 | Crowder et al. | 222/1 |
| 7,475,793 | B2 | * | 1/2009 | Wahl | 222/77 |
| 7,677,411 | B2 | * | 3/2010 | Crowder et al. | 222/1 |
| 2007/0170207 | A1 | * | 7/2007 | Kraus et al. | 222/199 |
| 2008/0017669 | A1 | | 1/2008 | MacMichael et al. | |

FOREIGN PATENT DOCUMENTS

| | | | | | |
|---|---|---|---|---|---|
| CN | 101464182 | A | | 6/2009 | |
| DE | 320137 | | | 4/1920 | |
| DE | 3838542 | A1 | | 5/1990 | |
| DE | 202007003535 | U1 | | 7/2007 | |
| GB | 1300063 | | | 12/1972 | |
| JP | 52168749 | U | | 12/1977 | |
| JP | 54182268 | U | | 12/1979 | |
| JP | 1134096 | U | | 9/1989 | |
| JP | 5162701 | A | | 6/1993 | |
| JP | 11248522 | A | | 9/1999 | |
| JP | 200280001 | A | | 3/2002 | |
| JP | 2002080001 | A | * | 3/2002 | B65B 1/08 |
| JP | 200529294 | A | | 2/2005 | |
| JP | 2005110786 | A | | 4/2005 | |
| JP | 2005536415 | A | | 12/2005 | |
| JP | 2008504179 | A | | 2/2008 | |
| JP | 2008094496 | A | | 4/2008 | |
| JP | 200940506 | A | | 2/2009 | |
| NL | 1019784 | C2 | | 7/2003 | |
| WO | 2008041538 | A1 | | 4/2008 | |

OTHER PUBLICATIONS

Notification of the Fourth Office Action for the Chinese Patent Application No. 201180042328.4, The Intellectual Property Office of the People's Republic of China, Jun. 30, 2015.

European Office Action, dated Dec. 22, 2015, in counterpart European Patent Application No. 11821923.7.

* cited by examiner

HOPPER AND MEDICINE SUPPLY APPARATUS INCLUDING THE SAME

TECHNICAL FIELD

The present invention relates to a hopper having a passage through which a medicine can be passed downward, and a medicine supply apparatus including the hopper.

BACKGROUND ART

A medicine dispensing and packing apparatus mounts therein a medicine supply apparatus. The medicine supply apparatus includes a hopper. The hopper has a passage through which a flowable medicine such as a powder medicine or a pill can be passed downward (for example, Patent Document 1).

When a medicine to be supplied to the hopper is changed to a medicine of a different type, a medicine before the change remaining in the hopper causes contamination. Thus, it is desirable to prevent a medicine from remaining in the hopper as much as possible.

CITATION LIST

Patent Document

Patent Document 1: Japanese Patent Laid Open No. 2009-40506

SUMMARY OF INVENTION

Technical Problem

Thus, there has been hitherto used a conventional method, which includes intermittently hitting and making an impact on the hopper so as to prevent a medicine from adhering to the hopper. However, this method generates significant noise due to hitting and provides an unpleasant feeling to an operator or the like around the apparatus.

Patent Document 1 proposes using a vibration motor to transmit vibration to a hopper. This can reduce noise as described above.

However, the invention according to Patent Document 1 does not consider a relationship between a material or a shape of the hopper itself and remaining of a medicine.

Therefore, it is an object of the present invention to provide a hopper to which a medicine is prevented from adhering by adding an external force, and a medicine supply apparatus including the hopper.

Solution to Problem

According to the first invention, there is provided a hopper having a passage through which a medicine can be passed downward, wherein the hopper is configured to cause rippling vibration on an inner surface thereof by an external force applied to the hopper.

According to this configuration, the rippling vibration generated in the hopper can apply a force to the medicine, thereby separating the medicine away from the inner surface of the hopper.

In the first invention, it may be configured so that the external force is vibration applied over the entire hopper, and the vibration of the external force is different from the vibration on the inner surface in terms of phase, amplitude, or cycle at a given time.

According to this configuration, the vibrations have different phases, amplitudes, or cycles. Thus, a force separating the medicine away from the inner surface of the hopper can be effectively applied to the medicine.

In the first invention, the hopper may be made of an elastic material.

According to this configuration, the hopper to which the medicine is prevented from adhering can be easily formed.

According to a second invention, there is provided a medicine supply apparatus including: the hopper; and a vibrator that provides vibration to the hopper.

According to this configuration, the vibrator provides rippling vibration to the inner surface of the hopper to apply a force to the medicine to separate the medicine away from the inner surface of the hopper.

In the second invention, the medicine supply apparatus may further include a hopper holder that holds the hopper, wherein the hopper holder includes the vibrator.

According to this configuration, the hopper holder and the vibrator generate rippling vibration on the inner surface of the hopper to apply a force to the medicine to separate the medicine away from the inner surface of the hopper.

In the second invention, the hopper holder may be supported by a vertically displaceable spring.

According to this configuration, larger vibration can be generated in the hopper.

In the second invention, the hopper holder holds the hopper at a portion between an upper end and a lower end of the hopper.

According to this configuration, a shape of the hopper can be simplified.

Advantageous Effect of Invention

According to the present invention, the hopper to which the medicine is prevented from easily adhering by adding an external force, and a medicine supply apparatus including the hopper can be provided.

BRIEF DESCRIPTION OF DRAWINGS

FIG. 5 shows an operation of the hopper according to the embodiment of the present invention.

DESCRIPTION OF EMBODIMENT

Figure 2:
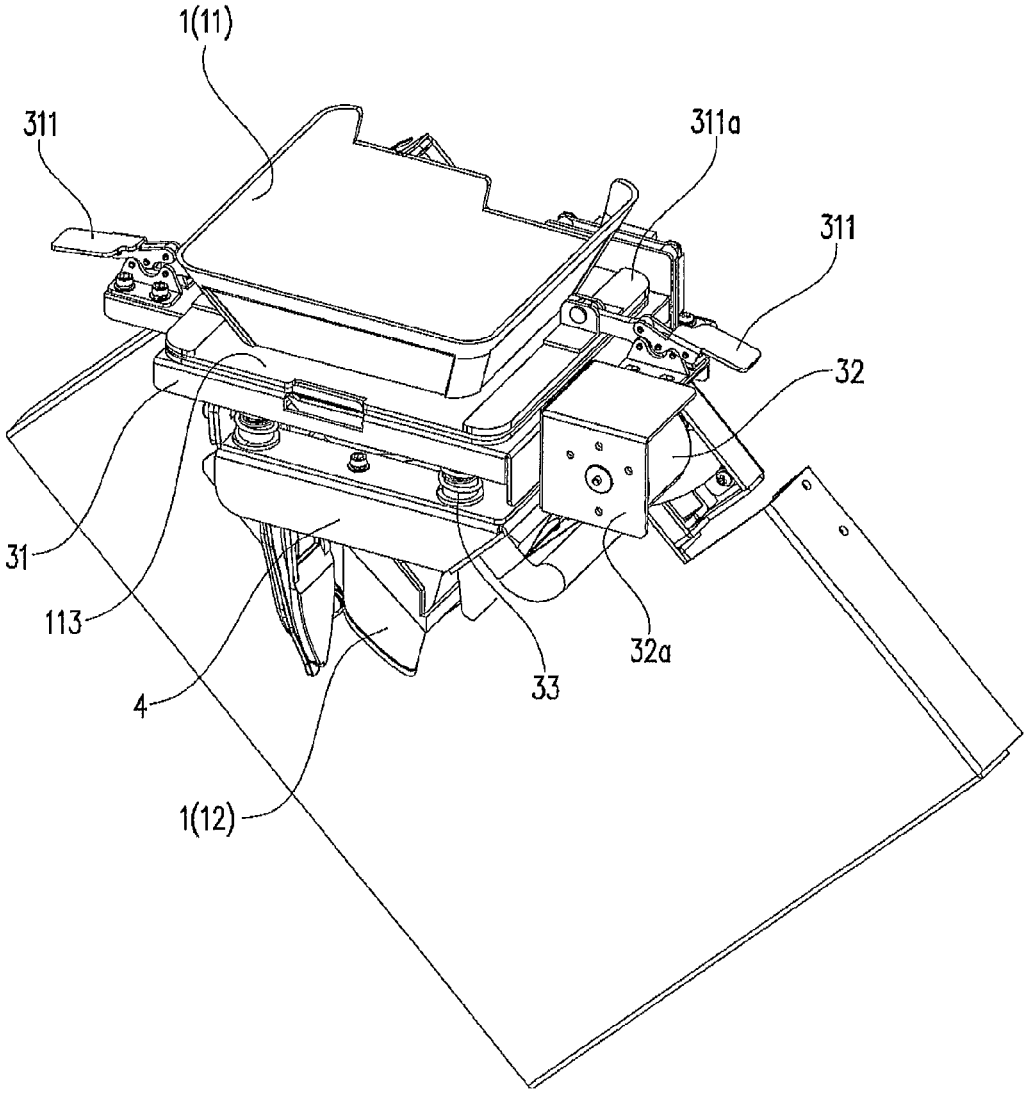
FIG. 2 is a perspective view of essential portions of a medicine dispensing and packing apparatus to which the hopper according to the embodiment of the present invention is mounted.
Figure 3:
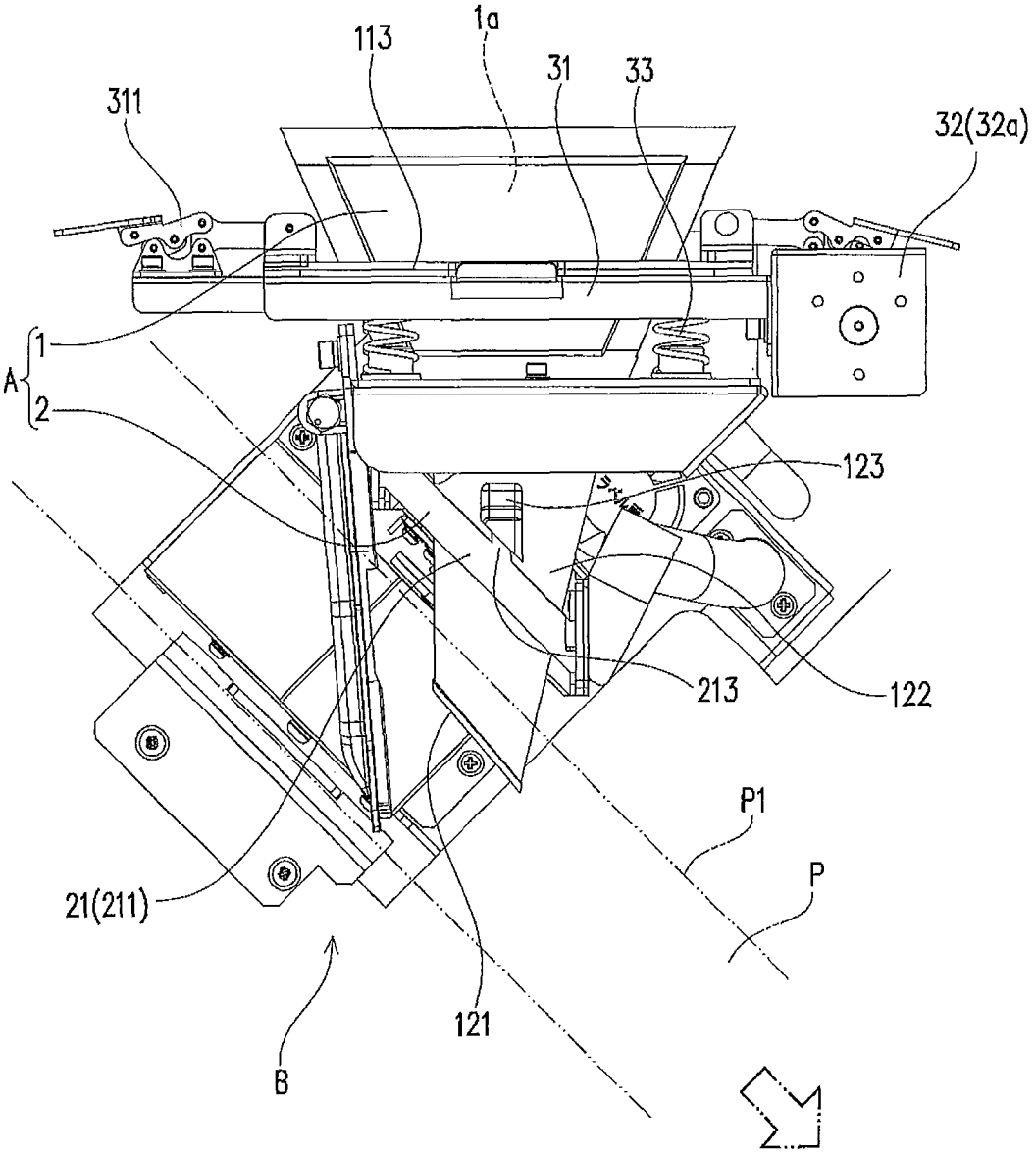
FIG. 3 is a front view of essential portions of the medicine dispensing and packing apparatus to which the hopper according to the embodiment of the present invention is mounted.

Now, an embodiment of the present invention will be described. First, a hopper 1 will be described. The hopper 1 and an opening and closing portion 2 described later constitute a medicine supply apparatus A. As shown in FIGS. 2 and 3, the medicine supply apparatus A is combined with a dispensing and packing apparatus B to constitute a medicine dispensing and packing apparatus.

—Configuration of Hopper—

Figure 1:
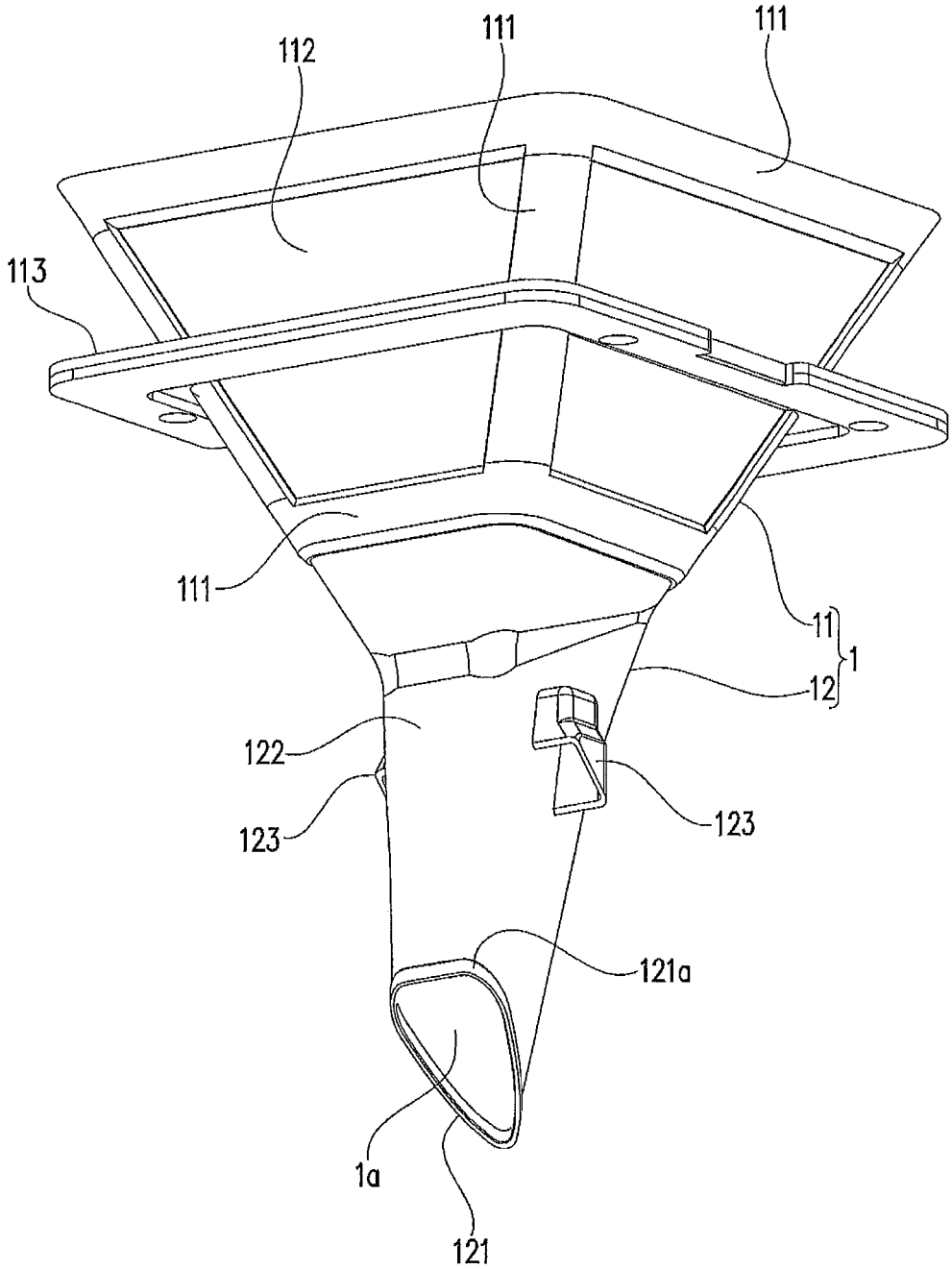
FIG. 1 is a perspective view of a hopper according to an embodiment of the present invention seen from a bottom side.

The hopper 1 of this embodiment has a shape as shown in FIG. 1, and has a passage 1*a* through which a medicine can be passed downward. In the medicine dispensing and packing apparatus, the hopper 1 is mounted so that the passage 1*a* is vertically oriented. The hopper 1 includes a hopper body 11 and a nozzle 12. The hopper body 11 is an upper part of the hopper 1. The hopper body 11 can store a medicine. The nozzle 12 is located below the hopper body 11. A lower end of the nozzle 12 is a medicine output port 121. The medicine stored in the hopper body 11 can be taken out from the medicine output port 121. The passage 1*a* has a smaller lateral cross sectional area in the nozzle 12 than in the hopper body 11 so that the medicine can be taken out. In a space through which the medicine passes in the passage 1*a*, no member is provided that constitutes an opening and closing mechanism for opening and closing the passage 1*a* (for example, an opening and closing plate or a hinge).

In this embodiment, the hopper 1 is made of rubber (more specifically, silicon rubber), and the hopper 1 is entirely integrally formed. The rubber is thus used to make it possible to easily form the hopper 1, and manufacture the hopper 1 to which a medicine is prevented from adhering at low cost. The integral forming of the hopper 1 can eliminate a joint or a step in the inner surface 1*b*, thereby preventing the medicine from easily remaining on the inner surface 1*b*. In addition, no member is provided that constitutes an opening and closing mechanism in the space through which the medicine passes in the passage 1*a* as described above. Thus, in the hopper 1 of this embodiment, a path through which the medicine passes does not include a portion on which the medicine may remain. Thus, the medicine is prevented from easily remaining in the entire hopper 1. The hopper 1 can be easily manufactured. Only the hopper 1 can be easily removed from the medicine supply apparatus A, thereby facilitating maintenance. Since the hopper 1 is integrally formed, rippling vibration generated on the inner surface 1*b* by an external force X as described later hardly attenuates during transmission, thereby allowing the vibration to be efficiently transmitted to the entire hopper 1.

However, the present invention is not limited to the hopper 1 integrally formed, but separate members may be combined to form the hopper. Also, the hopper 1 may be made of various materials as long as the materials can generate rippling vibration on the inner surface 1*b* of the hopper 1. The materials include, for example, metal or hard resin, or paper, and an elastic member such as rubber is particularly desirably used.

The inner surface 1*b* of the hopper 1 of this embodiment is subjected to surface treatment to reduce friction between the inner surface 1*b* and the medicine passing through the passage 1*a*. This prevents the medicine from easily remaining on the inner surface 1*b* of the hopper 1. The surface treatment is a coating of a material different from a material of the hopper 1 (for example, resin coating) in this embodiment. Alternatively, the surface treatment may be chemical treatment by melting the inner surface 1*b* using a chemical agent or the like, or physical treatment by sandblasting of the inner surface 1*b* as long as friction between the inner surface 1*b* and the medicine can be reduced.

—Hopper Body—

The hopper body 11 has a trumpet shape spreading upward, and has a substantially square lateral cross sectional shape in this embodiment. The hopper body 11 includes a relatively thick and rigid frame 111 formed in outer edges and four corners, and relatively thin and low rigid flat plate portions 112 surrounded by the frame 111. The frame 111 is provided to retain the shape. More specifically, the frame 111 is provided to prevent the hopper 1 from being deformed by a self-weight of the hopper 1, and a weight and drop pressure of the medicine passing through the passage 1*a*. The flat plate portion 112 has relatively lower rigidity in order to save materials and also for a vibrator 32 described later to vibrate the hopper 1 and ripple the inner surface 1*b* in the flat plate portion 112 to shake off a remaining medicine.

In the hopper body 11, a plate-like holder mounting portion 113 protrudes from an outer surface. The holder mounting portion 113 is used to secure the hopper 1 to the medicine supply apparatus A. In this embodiment, the holder mounting portion 113 horizontally protrudes from the hopper body 11 along its entire circumference, but may have various shapes as long as it can secure the hopper 1. The holder mounting portion 113 may be provided in any position from an upper end to a lower end of the hopper body 11.

—Nozzle—

The nozzle 12 is provided to be continuous with the lower end of the hopper body 11 with a lateral cross sectional area of the passage 1*a* decreasing downward. The lower end of the nozzle 12 is opened to be the medicine output port 121. The lower end is diagonally cut so that, as shown in FIG. 3, the medicine output port 121 in the medicine dispensing and packing apparatus is substantially parallel to a side end P1 of a packing paper P center-folded in a width direction, and conveyance of the packing paper P is not prevented. A lower edge 121*a* around the medicine output port 121 has a larger thickness than other portions of the nozzle 12. This ensures a shape retaining property at a lower end of the nozzle 12.

—Deformable Portion—

In this embodiment, the hopper 1 is integrally formed of silicon rubber, and thus the nozzle 12 is naturally made of silicon rubber. Thus, the entire nozzle 12 is a deformable portion 122 having flexibility, and the deformable portion 122 is deformable so as to open and close the passage 1*a*. The passage 1*a* is opened and closed by the opening and closing portion 2 described later. However, unlike this embodiment, an aspect in which the passage 1*a* is not opened and closed may be allowed as in an embodiment in FIG. 6. The deformable portion 122 is desirably made of a material that can maintain flexibility and also a shape restoring property over a long period in terms of economy. The deformable portion 122 allows the medicine to be once stored in the hopper 1. Even in the case where the passage 1*a* is not opened and closed as described above, or a case where the passage 1*a* is opened and closed and is half opened as described later, the passage 1*a* in the nozzle 12 has a decreasing lateral cross sectional area, and a dropping medicine hits the inner surface of the nozzle 12, thereby reducing a dropping speed of the medicine. This can prevent the medicine having dropped on the packing paper P center-folded in the width direction from rebounding upward and flying (referred to as "blowout").

The wording "opening and closing" may include three meanings: (1) the passage 1*a* is forcedly opened and closed, (2) the passage 1*a* is forcedly closed and naturally opened by an elastic force or the like of the deformable portion 122, and (3) the passage 1*a* is forcedly opened and naturally closed by the elastic force or the like of the deformable portion 122. A case where the passage 1*a* is kept half opened or half closed is also included. Thus, the aspect in which the passage 1*a* is closed is not limited to the passage 1*a* being fully closed, but includes the passage 1*a* being closed with an opening such that the medicine cannot be taken out. On the other hand, an aspect in which the passage 1*a* is opened has the passage 1*a* being slightly opened so that the medicine can substantially pass through.

In this embodiment, the passage 1*a* in the deformable portion 122 is configured to be opened when no external force is applied to the deformable portion 122, and forcedly closed by the opening and closing portion 2 described later. On the contrary, the deformable portion 122 may be configured so that the passage 1*a* is closed when no external force is applied to the deformable portion 122, and opened by the opening and closing portion 2.

—Lock Portion—

The deformable portion 122 includes a lock portion 123 on an outer surface. The lock portion 123 is used for deforming the deformable portion 122 in a direction of opening the passage 1*a*. As shown in FIG. 1, the deformable portion 122 in this embodiment has a pocket shape opening downward on the outer surface of a long side of the deformable portion 122. As shown in FIG. 3, when the hopper 1 is mounted to the medicine dispensing and packing apparatus, a hanging portion 213 (described later) on an opening and closing operation portion 21 is inserted into the pocket-shaped lock portion 123. The opening and closing operation portion 21 can be operated to open the passage 1*a* in the deformable portion 122.

The lock portion 123 may lock the opening and closing operation portion 21 so that the deformable portion 122 operates in association with the operation of the opening and closing operation portion 21, using various means such as bonding, clasping, or fitting. In this embodiment, the lock portion 123 has a pocket shape, and in removal of the hopper 1, the hanging portion 213 on the opening and closing operation portion 21 is unlocked from the lock portion 123 by simply moving the hopper 1 upward. This facilitates removal of the hopper 1, and thus facilitates cleaning of the hopper 1. In some cases, the lock portion 123 may be provided in the nozzle 12.

Hopper

Another Embodiment

Figure 6:
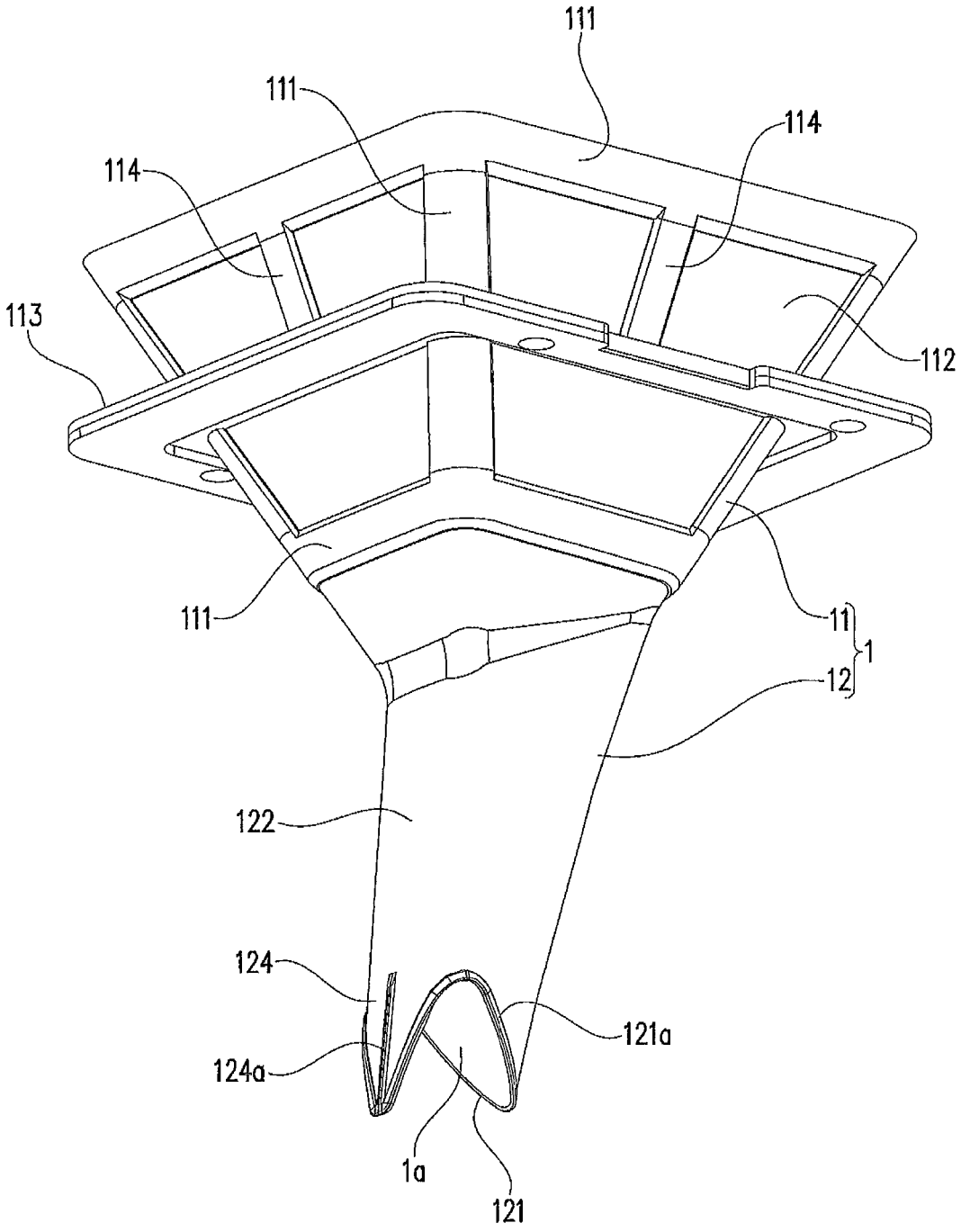
FIG. 6 is a perspective view of a hopper according to another embodiment of the present invention seen from a bottom side.

With reference to FIG. 6, another embodiment of a hopper 1 different from the hopper 1 of the above embodiment will be described. Only differences from the above descriptions will be described, and components having the same functions as those in the above embodiment are denoted by the same reference numerals. The hopper 1 of this embodiment does not use an opening and closing portion 2. The hopper 1 includes a triangular blowout preventing portion 124 protruding downward in a position on an upstream side of a moving direction (see FIG. 3) of a packing paper P at a lower end. In the case where the opening and closing portion 2 is not used, a medicine is not once stored in the hopper 1. Thus, the medicine drops from above without being stopped in midstream, thereby providing a stronger dropping force than in the case where the opening and closing portion 2 is used. Thus, using the hopper 1 of the above embodiment may cause the medicine having dropped on the packing paper P center-folded in the width direction to rebound upward and fly (referred to as "blowout"). In this embodiment, the blowout preventing portion 124 can prevent the medicine from moving upstream of the center-folded packing paper P. This can prevent or reduce "blowout". A reinforcing portion 124*a* having a larger thickness than other portions of the nozzle 12 is vertically provided outside the blowout preventing portion 124. Thus, the reinforcing portion 124*a* and the lower edge 121*a* together ensure a shape retaining property of a lower end of the nozzle 12. A hopper body 11 in this embodiment includes a frame 111, and also a vertical reinforcing portion 114 having a larger thickness than a flat plate portion 112 in a middle of a side surface. This increases a shape retaining property of the hopper body 11.

The material and the shape of the hopper 1 have been described above. In summary, the material and the shape of the hopper 1 may be selected to have rigidity such that when the external force X is applied to the hopper 1, the inner surface 1*b* is elastically deformed to cause rippling vibration. Since this rigidity cannot be converted into number, the material and the shape of the hopper 1 according to this embodiment are listed below as an example of the hopper 1 having such rigidity (sizes of another embodiment shown in FIG. 6 are listed).

Property Before Hardening

Plasticity (Williams re-kneading, after 10 minutes) 240

Property after hardening (measured using a test piece of 2 mm thick)

Density 1.14 g/cm$^3$, hardness (JIS type A) 52, tensile strength 8.2 MPa, stretch in cutting 325%, tearing strength 23 kN/m The property after hardening was measured using a test piece of 2 mm thick.

Size of Each Part (Outer Size)

Vertical entire length: 186 mm

Vertical size of hopper body 11: 68 mm

Upper end size of hopper body 11: 123 mm×123 mm

Lower end size of hopper body 11: 63 mm (front)×53 mm (side)

Size from upper end of hopper body 11 to upper end of holder mounting portion 113: 35.6 mm Width of frame 111: 7.5 mm Lower end size of nozzle 12 (maximum size): 33.5 mm (front)×26.5 mm (side)

Thickness: the whole . . . 0.6 mm, frame 111 and upper reinforcing portion 114 . . . 1.8 mm, frame 111 at upper end of hopper body 11 . . . 2 mm, lower edge 121*a* and reinforcing portion (blowout preventing portion) 124*a* . . . 1.1 mm, holder mounting portion 113 (base side) . . . 2 mm, holder mounting portion 113 (portion held by securing clip 311) . . . 4 mm —Behavior of Hopper by External Force—

The hopper 1 is formed as described above, and the external force X is applied to the hopper 1 to cause rippling vibration on the inner surface 1*b*. The external force X is vibration applied to the entire hopper 1 by a vibrator 32 described later in this embodiment.

The "external force (X)" is not limited to vibration having constant amplitude and frequency as vibration generated by a vibration motor that is the vibrator 32 in this embodiment. The "external force (X)" may be vibration with changing amplitude and frequency, or an impact generated, for example, by a solenoid (in other words, an intermittent impact with changing amplitude and frequency, which can be regarded as one type of vibration).

Various types of "rippling vibration" are conceivable, and include, as examples, vibration having a different phase, different amplitude, or a different cycle (frequency) at the same time from those of the vibration of the external force X. In other words, the vibration is generated on the inner surface 1*b* of the hopper 1 in the case where vibrations have different phases at the same time such as the case where the vibration generated on the inner surface 1*b* of the hopper 1 has a different waveform from that of the vibration of the external force X, or the case where the vibration has the same waveform but a different peak time of the waveform. The amplitude and the cycle (frequency) of vibration having changing waveform with time can be determined from average values of amplitudes and cycles (frequencies) within a time range from a certain time to a time after a predetermined time.

Figure 5A:
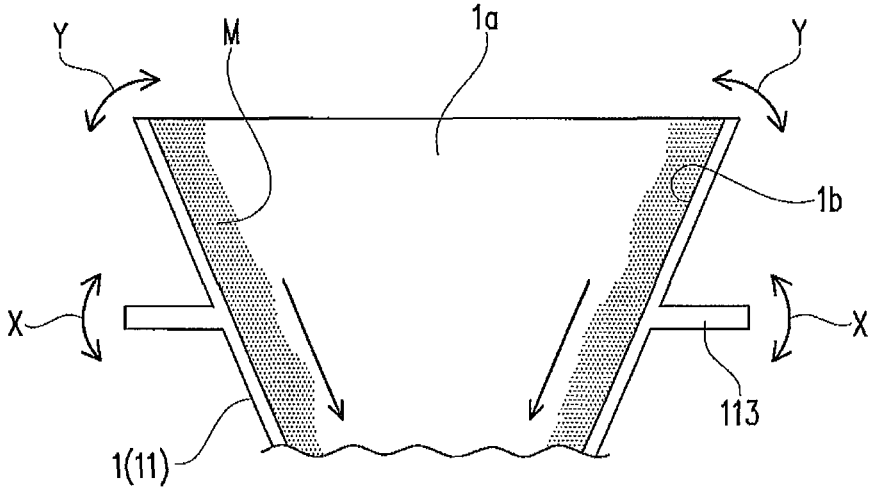
FIG. 5(A) is a vertical sectional schematic view of a hopper body.
Figure 5B:
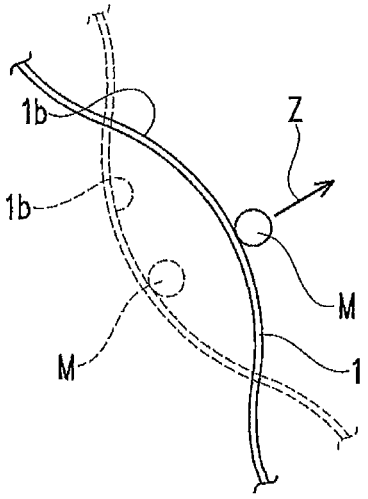
FIG. 5(B) is an enlarged schematic view of essential portions showing rippling on an inner surface of the hopper.

By the rippling vibration thus generated, as shown in FIG. 5(B), a separation force z from the inner surface 1*b* of the hopper 1 can be applied to each medicine M in a microscopic sense. Thus, as shown in FIG. 5(A), the medicine M can be shaken off from the inner surface 1*b* of the hopper 1. This prevents the medicine M from remaining on the hopper 1.

In order to effectively shake off the medicine M from the inner surface 1*b* of the hopper 1, the vibration on the inner surface 1*b* is desirably vibration that can apply, to the medicine M, a separation force Z stronger than adhesion (frictional force or the like) of the medicine M to the inner surface 1*b*. However, even if a separation force Z weaker than the adhesion is applied to the medicine M, an operation to reduce adhesion of the medicine M to the inner surface 1*b* can be achieved. Thus, such a weak separation force Z is not useless but is effective to some extent. As in this embodiment, the inner surface 1*b* is desirably subjected to surface treatment to reduce adhesion of the medicine M to the inner surface 1*b*.

The vibration to apply the "separation force Z stronger than the adhesion" to the medicine M has, for example, a waveform with large amplitude or a short cycle.

The hopper 1 of the this embodiment is made of silicon rubber, and as shown in FIGS. 2 and 3, secured to the medicine supply apparatus A by the holder mounting portion 113. Thus, vibration generated by the vibration motor that is the vibrator 32 is transmitted from a hopper holder 31 described later to the holder mounting portion 113, and then transmitted to the entire hopper 1.

Since the hopper 1 of this embodiment is made of silicon rubber and has flexibility or is soft, as shown in FIG. 5(A), the transmitted vibration causes deflection Y. The deflection Y occurs in the entire inner surface 1*b* of the hopper 1 to cause the "rippling vibration". The deflection Y increases (that is, the amplitude of the "rippling vibration" increases) with increasing distance from the holder mounting portion 113. Thus, on the inner surface 1*b* of the hopper 1, vibration near the holder mounting portion 113 is substantially equal to the vibration by the vibrator 32, while vibration in other portions has larger amplitude than the vibration by the vibrator 32. Thus, it is assumed that a stronger force can be applied to the medicine M in the hopper 1 to effectively shake off the medicine M as compared to the vibration by the vibrator 32 being directly transmitted to the entire hopper 1, In this embodiment, the inner surface 1*b* of the entire hopper 1 (the hopper body 11 and the nozzle 12) vibrates in a rippling manner, but not limited to this. For example, if there is a spot in the hopper 1 to which the medicine M easily adheres in terms of arrangement of the hopper 1 in the medicine supply apparatus A, rippling vibration may be intensively generated on the inner surface 1*b* of the spot, or rippling vibration may be generated only on the inner surface 1*b* of the spot in some cases. This can be achieved by changing the shape of the hopper 1 to locally form a portion having high rigidity, or partially using a material hard to vibrate or a material that absorbs vibration.

—Medicine Supply Apparatus and Medicine Dispensing and Packing Apparatus—

Next, the medicine supply apparatus A and the medicine dispensing and packing apparatus will be described. The medicine supply apparatus A includes the hopper 1, and the opening and closing portion 2 that opens and closes the passage 1*a* so that a predetermined amount of medicine can be taken out. The medicine dispensing and packing apparatus includes the medicine supply apparatus A, and a dispensing and packing apparatus B for packing the medicine supplied by the medicine supply apparatus A using the packing paper P. The dispensing and packing apparatus B center-folds, in a width direction, the packing paper P continuously supplied in a length direction, packs a medicine for one pack supplied from a medicine supply container with the packing paper P, and then bonding a circumference of the packing paper P by heat sealing or the like. Essential portions of the medicine dispensing and packing apparatus are shown in FIGS. 2 and 3. The packing paper P center-folded in the width direction is shown by chain double-dashed lines. A moving direction of the packing paper P is as indicated by an arrow in the Figures.

As shown in the Figure, the lower end of the nozzle 12 in the hopper 1 is located to be held by the center-folded packing paper P. An end surface shape of the medicine output port 121 is an isosceles triangle as shown in FIG. 1, and an apex of the shape is located on a downstream side in the moving direction of the packing paper P.

—Hopper Holder—

As shown in FIGS. 2 and 3, in this embodiment, the hopper 1 is locked and held in a hopper holder 31 having a rectangular frame shape. The hopper holder 31 is provided at a portion between the upper end and the lower end of the hopper 1. Thus, the holder mounting portion 113 may be simply formed to protrude from the outer surface of the hopper 1, thereby simplifying the shape of the hopper 1. The hopper holder 31 includes a securing clip 311. The holder mounting portion 113 of the hopper 1 can be held by a pressing piece 311*a* of the securing clip 311 to hold the hopper 1 in the hopper holder 31. In this embodiment, the pressing piece 311*a* is formed to be wide so as to hold one side of the holder mounting portion 113 over the entire width as shown. Thus, as described later, the vibration generated by the vibrator 32 can be effectively transmitted to the hopper 1.

The hopper holder 31 is supported by a vertically displaceable spring 33. The spring 33 operates to vibrate the hopper 1 as described later, and operates as means (vibration insulating means) for preventing the vibration by the vibrator 32 from being transmitted to portions other than the medicine supply apparatus A of the medicine dispensing and packing apparatus.

In this embodiment, a coil spring is used as the spring 33. The coil springs are connected to a base 4 secured to the apparatus at four places: two on one side and two on the other side of the hopper holder 31 having a rectangular frame shape. The spring 33 is not limited to the coil spring, but may be various springs such as a leaf spring. It is desirable that the spring 33 mainly vibrates in an axial (vertical) direction, and does not substantially vibrate in a radial direction (horizontal direction). In this embodiment, the coil spring is used as it is, but a guide may be provided that allows vertical vibration while positively regulating vibration in the radial direction (horizontal direction) of the coil spring such as by providing a cylindrical inner guide inside the coil spring, or providing a cylindrical outer guide outside the coil spring.

—Vibrator—

The hopper holder 31 in this embodiment includes the vibrator 32 that vibrates the hopper 1. For the vibrator 32 in this embodiment, a vibration motor having an eccentric weight mounted to a rotating shaft of the motor is used as a vibration source to generate vibration having constant amplitude and frequency. The vibrator 32 may be conventional means for generating an impact using a solenoid or the like. The vibrator 32 may be means for generating vibration using an electromagnet or the like.

In this embodiment, the vibrator 32 operates in association with the dispensing and packing apparatus B. Specifically, the vibrator 32 operates at timing when a medicine is supplied from the medicine output port 121 in the hopper 1 to the dispensing and packing apparatus B. The vibrator 32 may be manually operated without operating in association with the dispensing and packing apparatus B, or in some cases, the vibrator 32 may be always operated during power-on of the medicine dispensing and packing apparatus.

As described above, the hopper holder 31 is supported by the spring 33, and thus the vibration generated by the vibrator 32 vibrates the hopper holder 31 and thus vibrates the hopper 1. Thus, as compared to the hopper holder 31 being secured, larger vibration can be generated in the hopper 1. This can effectively shake off the medicine M remaining in the hopper 1.

As shown in FIG. 2, the vibrator 32 in this embodiment is secured via a mounting portion 32*a* formed of a metal plate in a position closer to one end in a longitudinal direction of one side of the hopper holder 31. The vibrator 32 is secured so that the rotating shaft of the vibration motor is horizontal. The mounting position of the vibrator 32 is closer to a corner of the hopper holder 31 having a rectangular frame shape. Thus, in this embodiment, the position closer to the corner of the hopper holder 31 having a rectangular frame shape is a vibration generating position.

Thus, in this embodiment, the vibration in the hopper 1 generated by the transmitted vibration by the vibrator 32 is mainly vertical vibration by the operation of the spring 33. It is assumed that the vibration in the hopper 1 is the vertical vibration plus slight rotational vibration around a vertical axis based on the hopper holder 31 being supported by the springs 33 at four places, and the position closer to the corner of the hopper holder 31 being the vibration generating position due to the biased securing position of the vibrator 32.

In this embodiment in which the vibration as described above is transmitted to the hopper 1, it is assumed that a predetermined spot of the hopper 1 follows "a vertical trajectory along the vertical axis plus a slight rotational trajectory around the axis" by the vibration.

As described above, the vibration in the hopper 1 is a combination of the vertical vibration and the rotational vibration around the vertical axis. This can effectively shake off the medicine M remaining on the hopper 1. Since such combined vibration is generated in the hopper 1, the vibrator 32 is desirably provided in a biased position of the hopper holder 31.

The vertical vibration in the hopper 1 attenuates as being transmitted through the hopper holder 31, and is assumed to be larger in a position closer to the vibrator 32. Thus, the vibration in the hopper 1 may be uneven depending on positions. Thus, the uneven vibration can also effectively shake off the medicine M remaining in the hopper 1.

—Opening and Closing Operation Portion—

Figure 4:
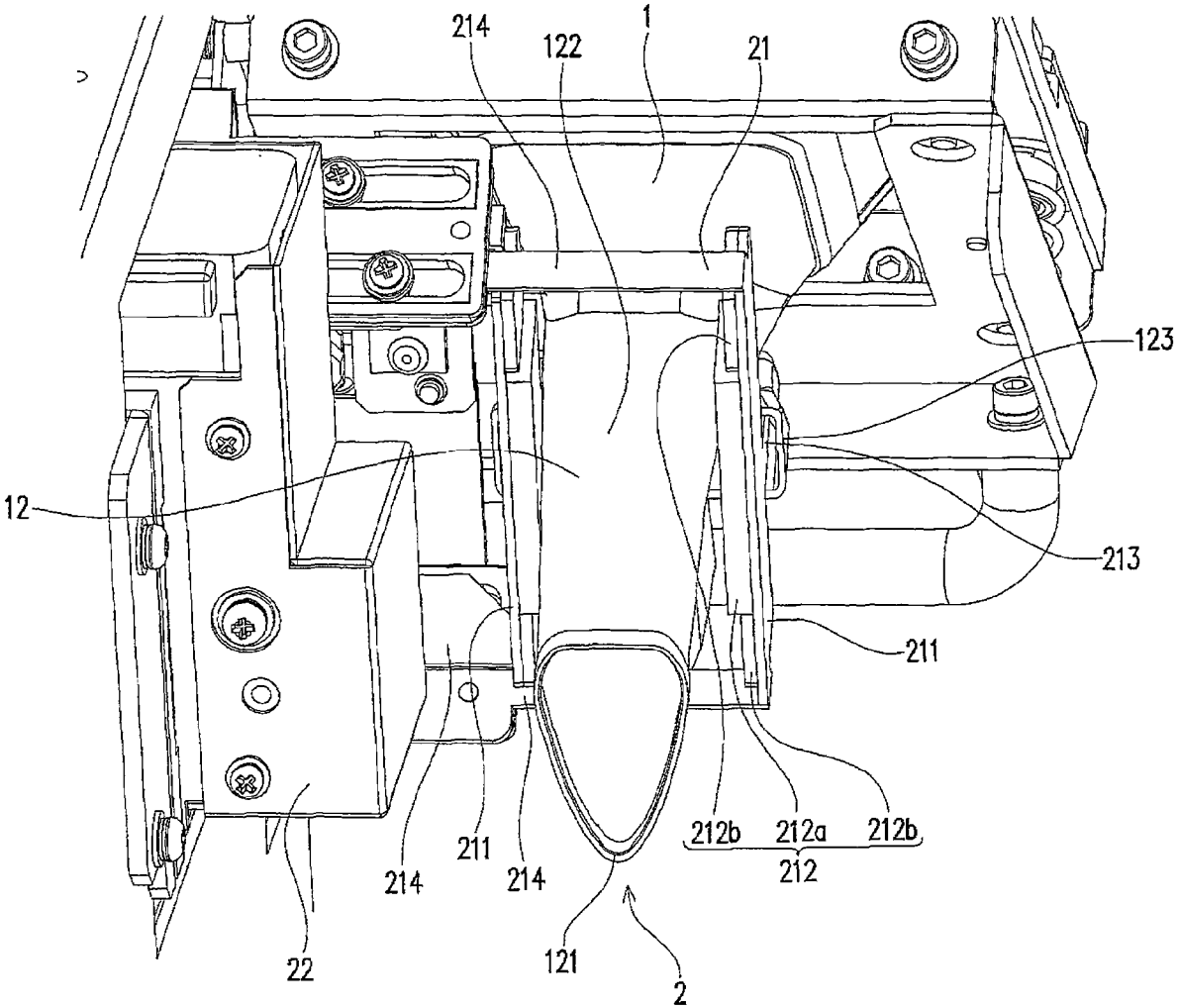
FIG. 4 is a side view of essential portions around an opening and closing portion in the medicine dispensing and packing apparatus to which the hopper according to the embodiment of the present invention is mounted.

As shown in FIG. 4, the opening and closing portion 2 includes a pair of opening and closing operation portions 21 that can hold the deformable portion 122 in the nozzle 12 of the hopper 1 from one side and the other side, and a driving portion 22 for driving the opening and closing operation portions 21. Each of the opening and closing operation portions 21 is made of metal and has a rectangular sectional shape with one side removed. The opening and closing operation portion 21 includes pressing portions 211 that each have an elongated plate shape and can come close to each other to press the deformable portion 122, and coupling portions 214 extending from opposite ends of the pressing portions 211 to the driving portion 22. The pressing portions 211, 211 extend diagonally (that is, in a direction crossing a vertical direction so as to cross the deformable portion 122 on side view). The pressing portions 211 and 211 are parallel to each other with the deformable portion 122 therebetween. As shown in FIG. 3, the pressing portions 211, 211 are provided in parallel with the lateral side of the packing paper P on an outside of the packing paper P moving in the medicine dispensing and packing apparatus.

The pressing portions 211, 211 are provided on the outside of the packing paper P because if the pressing portions 211, 211 are located within lines (a range of the chain double-dashed lines in FIG. 3) of the packing paper P, timing when a paper holder (not shown) for holding the packing paper P on a downstream side of the nozzle 12 holds the packing paper P matches timing when the opening and closing portion 2 opens the deformable portion 12 (that is, the pressing portions 211, 211 apply opposite forces to the packing paper P), thereby causing a tear of the packing paper P. Further, if the pressing portions 211, 211 are located within the lines of the packing paper P, the medicine may adhere to the pressing portions 211, 211.

The opening and closing operation portion 21 is provided above the lower end of the hopper 1. Thus, the opening and closing operation portion 21 is separated from the medicine passing through the passage 1*a* by the hopper 1, and the medicine does not remain around the opening and closing operation portion 21. The opening and closing operation portion 21 is provided as close as possible to the lower end of the hopper 1 so as to reduce a dropping distance of the medicine, and prevent "blowout" of the medicine.

In this embodiment, the driving portion 22 is provided on a lateral side of the nozzle 12. The opening and closing operation portion 21 on a right side in the Figure is moved to left in the Figure when the passage 1*a* of the hopper 1 is closed, and the opening and closing operation portion 21 on a left side in the Figure is moved to right in the Figure when the passage 1*a* of the hopper 1 is closed. The driving portion 22 is driven by a motor, and meshing of gear (not shown) moves the coupling portions 214 to left and right in the Figure. During the movement, the pressing portions 211, 211 are kept in parallel with each other.

The shape and the operation of the pressing portion 211 are not limited to those in this embodiment, but may be changed in various manners. For example, the pressing portion 211 includes a cantilevered pressing portion, a pressing portion by cylinder driving, and a pressing portion having a hinge at one end and pivotally moved. In short, the pressing portion 211 may be changed in any manners as long as it moves relative to the deformable portion 122, and can deform the deformable portion 122 so as to open and close the passage 1*a*. Only an operation in a pressing direction (direction approaching the deformable portion 122) may be performed by the driving portion 22, and an operation in an opposite direction may be performed by repulsion of a spring or the like (rather than by the driving portion 22).

In a case where the deformable portion 122 of the hopper 1 is configured to be closed when an external force is not applied to the passage 1*a*, and opened by the opening and closing portion 2, for example, only a hanging portion 213 described later may be provided to open the passage 1*a* without providing the pressing portion 211 in the opening and closing operation portion 21.

—Cushioning Portion—

Each of the pressing portions 211, 211 in this embodiment includes an elastic cushioning portion 212 on an inner surface (that is, a portion facing the deformable portion 122 of the hopper 1). The cushioning portion 212 can absorb unevenness in thickness of the deformable portion 122 due to a formation error of the hopper 1. Specifically, if the pressing portions

211, 211 that are made of metal and are not elastic as in this embodiment directly press the deformable portion 122 when the deformable portion 122 has an uneven thickness over the entire circumference, it is difficult to achieve close contact of the deformable portion 122 to fully close the passage 1*a*. Thus, the cushioning portion 212 can press a portion with a smaller thickness in the deformable portion 122 with a relatively large force. The cushioning portion 212 can press a portion with a larger thickness in the deformable portion 122 with a relatively small force. This can fully close the passage 1*a*. In some cases, the cushioning portion 212 may be provided on an inner surface of any one of the pressing portions 211, 211.

In order to achieve close contact of the deformable portion 122 to close the passage 1*a*, the end of the passage 1*a* needs to be deformed to be folded. Thus, in order to fully close the passage 1*a*, a pressing force at the end of the passage 1*a* needs to be larger than a pressing force at a center portion of the passage 1*a*. Thus, in this embodiment, a cushioning portion 212*a* closer to the center portion in an extending direction of the pressing portions 211, 211 has higher elasticity than cushioning portions 212*b* closer to opposite ends. In other words, the cushioning portion 212*a* closer to the center portion is softer than the cushioning portions 212*b* closer to the opposite ends. In this embodiment, the cushioning portion 212*a* closer to the center portion is made of sponge, and the cushioning portions 212*b* closer to the opposite ends are made of rubber. Thus, a larger pressing force can be applied to the ends of the passage 1*a* in a state, thereby reliably closing the passage 1*a*. In this embodiment, in order to provide a balance of pressing forces, the cushioning portion 212*a* closer to the center portion is thicker than the cushioning portions 212*b* closer to the opposite ends. Thus, the cushioning portion 212*a* closer to the center portion first presses the center portion of the deformable portion 122, and then a little late, the cushioning portions 212*b* closer to the opposite ends press the opposite end portions of the deformable portion 122. Thus, the passage 1*a* can be reliably closed without uneven close contact.

The pressing portion 211 of each of the opening and closing operation portions 21, 21 in this embodiment includes the hanging portion 213 formed integrally therewith to protrude upward. As shown in FIGS. 2 and 3, the hanging portion 213 is inserted into the pocket-shaped lock portion 123 provided in the nozzle 12. When the pressing portion 211 is moved in a direction away from the deformable portion 122, the hanging portion 213 moves the deformable portion 122 in a direction of opening the passage 1*a*. This can reliably open the passage 1*a*. The passage 1*a* may be naturally opened by elasticity of the deformable portion 122 itself without using the hanging portion 213.

The invention claimed is:

1. A medicine supply apparatus comprising:

a hopper having a passage through which a medicine can be passed downward, wherein the hopper is made of an elastic material, is entirely integrally formed, and is configured to cause rippling vibration on an inner surface thereof by an external force applied to the hopper, the hopper includes a hopper body which is an upper part of the hopper and has an upwardly spreading shape, and a nozzle which is located below the hopper body, the hopper body includes a relatively thick and rigid frame, and relatively thin and low rigidity flat plate portions surrounded by the frame, a vibrator that provides vibration to the hopper, and a hopper holder that holds the hopper body, wherein the hopper holder is supported by a vertically displaceable spring and includes the vibrator, wherein the spring is configured to vibrate in an axial direction and is configured substantially not to vibrate in a radial direction, and a mounting position of the vibrator is closer to a corner of the hopper holder having a rectangular frame shape.

2. The medicine supply apparatus according to claim 1, wherein the hopper body comprises a holder mounting portion which protrudes from an outer surface of the hopper body, and the holder mounting portion is held by the hopper holder.

* * * * *